US005603768A

United States Patent [19]

Yoon et al.

[11] Patent Number: 5,603,768

[45] Date of Patent: Feb. 18, 1997

[54] FLOW-INDUCING PANELS FOR ELECTROLESS COPPER PLATING OF COMPLEX ASSEMBLIES

[75] Inventors: Sunghee Yoon, Lakewood; Mark R. Forsyth, El Segundo, both of Calif.

[73] Assignee: Hughes Electronics, Los Angeles, Calif.

[21] Appl. No.: 278,682

[22] Filed: Jul. 21, 1994

Related U.S. Application Data

[63] Continuation of Ser. No. 750,137, Aug. 26, 1991, abandoned.

[51] Int. Cl.[6] ..... B05C 13/00

[52] U.S. Cl. ..... 118/500; 204/297 W

[58] Field of Search ..... 204/297 R, 297 W, 204/275; 49/366; 248/220.3, 220.4, 222.1, 222.2; 427/437, 443.1, 304, 305; 118/500, 501, 503

[56] References Cited

U.S. PATENT DOCUMENTS

| | | | |
|---|---|---|---|
| 2,073,679 | 3/1937 | Brown | 204/297 R |
| 2,691,144 | 10/1954 | Parsons et al. | 204/297 R |
| 3,257,308 | 6/1966 | Cottom | 204/297 W |
| 3,376,210 | 4/1968 | Kiefer et al. | 204/297 W |
| 3,648,653 | 3/1972 | Vehse | 118/500 |
| 3,972,785 | 8/1976 | Palisin, Jr. | 204/297 R |
| 4,312,716 | 1/1982 | Maschler et al. | 204/297 R |
| 4,322,592 | 3/1982 | Martin | 118/500 |
| 4,589,369 | 5/1986 | Mahler | 118/500 |
| 4,634,512 | 1/1987 | Allen et al. | 118/500 |

FOREIGN PATENT DOCUMENTS

| | | | |
|---|---|---|---|
| 5230946 | 11/1977 | Japan | 118/503 |
| 1167663 | 7/1985 | U.S.S.R. | 118/500 |

*Primary Examiner*—Brenda A. Lamb

*Attorney, Agent, or Firm*—Leonard A. Alkov; Wanda K. Denson-Low

[57] ABSTRACT

Flow-inducing panels for use in electroless copper plating of complex plastic microwave assemblies. A panel comprises a rigid baffle having openings adapted to secure microwave assemblies therein. The panel has a size relative to the electroless copper plating tank that causes sufficient plating solution flow through the channels in the microwave assemblies by minimizing solution flow bypassing of the channels. This achieves complete copper plating of the inner surfaces in the channels. A relatively large panel builds up back pressure as it approaches plating tank walls, which creates a pressure differential as it moves through the plating tank, thus forcing solution through the channels. The flow-inducing panels easily hold many parts in a stabilized manner which yields high productivity, and provide solution flow through the channels using a standard metallization basket used for printed wiring board manufacturing.

9 Claims, 4 Drawing Sheets

FLOW-INDUCING PANELS FOR ELECTROLESS COPPER PLATING OF COMPLEX ASSEMBLIES

This invention was made with Government support under Contract No. F33657-81-C-0067 awarded by the United States Air Force. The Government has certain rights in this invention.

This is a continuation of application Ser. No. 07/750,137 filed Aug. 26, 1991 now abandoned.

BACKGROUND

The present invention relates generally to electroless copper plating, and more particularly, to flow-inducing panels for use in electroless copper plating of complex assemblies.

It is now the trend in the aerospace industry to electroless copper plate plastics, which provides for cost-effective and light weight complex microwave assemblies compared to complex microwave assemblies fabricated using machined metal. Sufficient solution flow through the channels in complex microwave assemblies is critical to ensure the complete coverage of electroless copper plating on the inner surfaces of the channels. It is therefore an objective of the present invention to provide flow-inducing panels that provide sufficient solution flow through the channels in complex microwave assemblies in the easiest and most reliable manner.

SUMMARY OF THE INVENTION

In order to achieve the above and other objectives, the present invention provides for a flow-inducing panel for use in electroless copper plating of complex plastic assemblies. The flow inducing panel of the present invention is adapted for use in electroless copper plating of complex microwave assemblies. In its broadest aspects, the panel comprises a rigid baffle having a plurality of openings therein adapted to secure a plurality of microwave assemblies. The rigid baffle has a size relative to an electroless copper plating tank that is adapted to cause sufficient plating solution flow through the channels in the microwave assemblies by minimizing solution flow bypassing of the channels. This achieves complete copper plating of the inner surfaces in the channels. Means is provided for securing each of the plurality of complex microwave assemblies in respective ones of the plurality of openings of the rigid baffle.

The flow-inducing panels comprise single channel and multi-channel embodiments. In the single channel embodiment the rigid baffle is comprised of a plurality of substantially coplanar rigid baffles that are joinable to form a single panel and which are secured together using covers and securing means for mating the covers to each of the panels. Typically, the rigid baffles are machined from a single copper clad panel and are joined to form a single panel using a plurality of covers and screws to mate the covers to each of the panels.

The means for securing the microwave assemblies in the panel comprises either rubber or plastic plugs. In the multi-channel embodiment the rigid baffle is comprised of a single panel and the plurality of openings comprises a plurality of slots disposed in the single panel that each have a stepped portion. The slot and stepped portion are adapted to secure the microwave assembly therein and permit plating solution to flow through the channels of the microwave assembly. The microwave assemblies are typically secured in the plurality of slots using a cover secured by means of screws that mate the cover block to the panel.

The flow-inducing panels of the present invention induce maximized solution flow through channels in the complex microwave assemblies by minimizing solution flow bypassing. A large (12 inch×18 inch) flow-inducing panel creates a pressure differential as it moves through the plating tank, thus forcing solution through the channels in the complex microwave assemblies.

The purpose of the flow-inducing panels of the present invention is to provide sufficient solution flow through the channels in complex microwave assemblies. The complete coverage of electroless copper plating on the inner surfaces of the channels is necessitated to ensure minimum RF energy loss in the channels. The advantages of the present flow-inducing panels are to easily hold many parts in a stabilized manner which yields high productivity, and to easily provide solution flow through the channels using a standard metallization basket.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
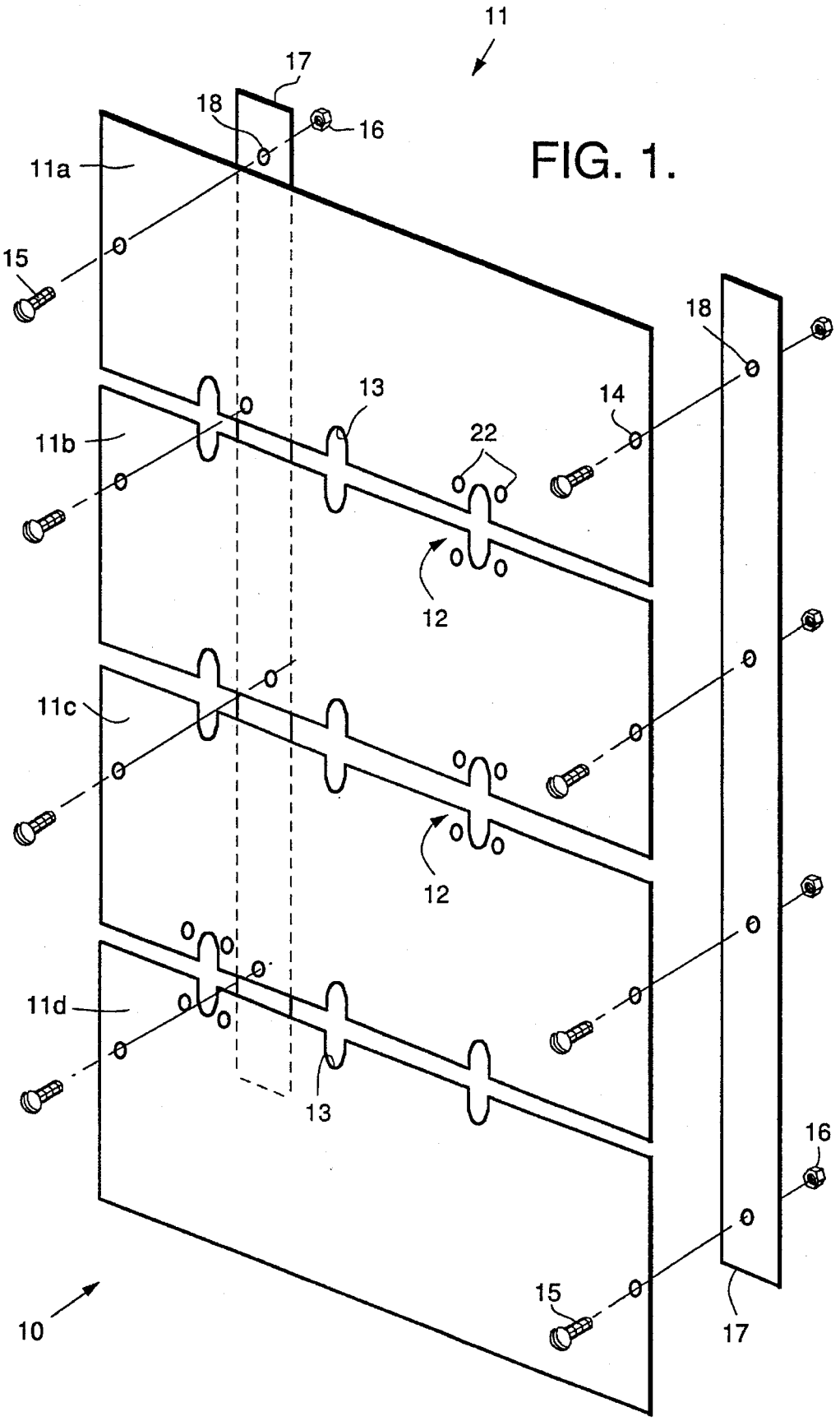
FIG. 1 shows an exploded perspective view of a single channel complex microwave assembly flow-inducing panel in accordance with the principles of the present invention.
Figure 2:
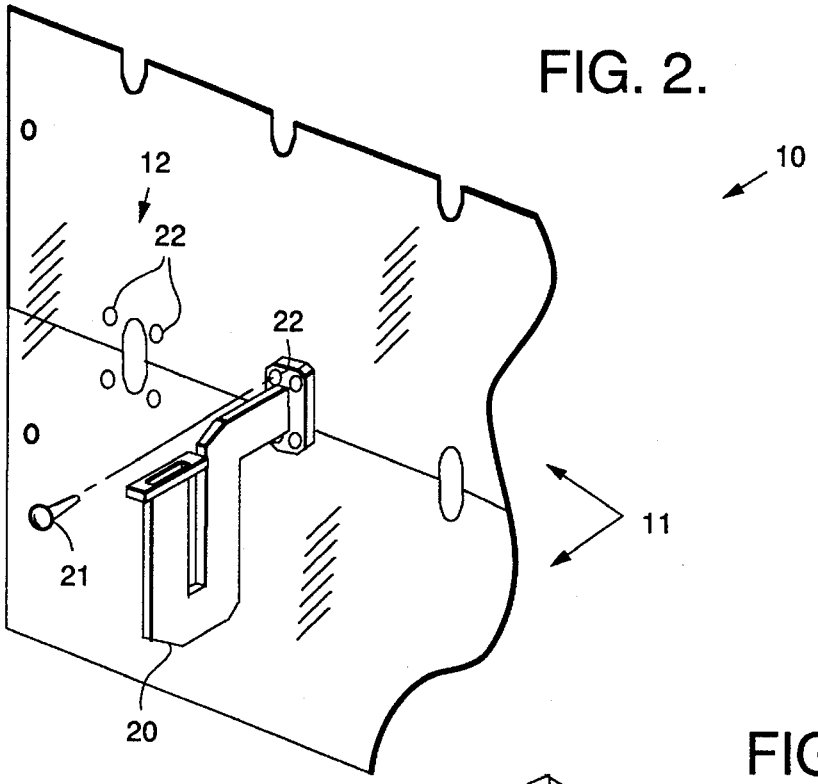
FIG. 2 shows a portion of perspective view of the assembled single channel complex microwave assembly flow-inducing panel of FIG. 1 having a complex microwave assembly disposed therein.

Referring to the drawing figures, and by way of example only, FIG. 1 shows an exploded perspective view of an embodiment of a single channel complex microwave assembly flow-inducing panel 10 in accordance with the principles of the present invention. FIG. 2 shows a portion of perspective view of the assembled single channel flow-inducing panel 10 of FIG. 1 having a complex microwave assembly 20 disposed therein.

The single channel flow inducing panel 10 is comprised of a copper clad panel 11 that is machined to provide a plurality of holes 12 therein formed in a plurality of rows. Each row of holes 12 is staggered with respect to an adjacent row of holes. This permits additional complex assemblies 20 to be fixtured in the single channel panel 10 for plating. The copper clad panel 11 is sheared into four subpanels 11*a*–11*d*. This permits the complex assemblies 20 to be easily inserted into the single channel flow inducing panel 10 for plating and permits plating of the edges of the complex assemblies 20. The copper clad panel 11 has through holes 14 disposed along its respective edges. The through holes 14 permits the assembling of the single channel panel 10 by means of machine screws 15 and nuts 16, for example, using a plurality of cover blocks 17 or covers 17 having holes 18 therein that mate with the through holes 14 of the single channel panel 11.

With reference to FIG. 2, the complex microwave assembly 20 is shown disposed in one to the holes 12 in an assembled single channel panel 10. To accomplish this, a plurality of rubber or plastic plugs 21 are inserted into holes 22 (only some of which are shown) that mate with corresponding holes in the complex microwave assembly 20. The rubber or plastic plugs 21 grip the microwave assembly 20, and secures the it in the hole 12 during plating and transport.

More specifically, the single channel embodiment of the present invention typically comprises a 12 inch×18 inch copper clad panel 11 routed to make nine holes 12 and then sheared into four subpanels 11*a*–11*d* to permit plating of the flange surfaces of the complex assemblies 20. Three holes 12 in a middle row of holes 12 are displaced quarter hole-distance from holes 12 in adjacent rows in order for the complex assemblies 20 located in the middle row not to contact the complex assemblies 20 in other rows. After the insertion of nine complex assemblies 20 into the holes 12, the four subpanels 11*a*–11*d* are assembled using the cover blocks 17, screws 15 and nuts 16 to form the single channel panel 10. The complex assemblies 20 are secured in the holes 12 using the rubber or plastic plugs 21 that are pulled through the holes 22 and the mating holes of the complex assemblies 20 and are stretched so that the plugs 21 frictionally secure the assemblies to the panel 10.

Typically, two assembled single channel panels 10 are placed in a conventional metallization basket used for printed wiring board (PWB) manufacturing (not shown). This configuration was used to test the present invention for operability. The single channel complex microwave assembly flow-inducing panels 10 of the present invention were tested for electroless copper plating during a proof-of-manufacturing test period. Complete coverage of electroless copper plating on inner surfaces of the complex channels 20 was obtained using the single channel flow-inducing panel 10 of the present invention.

Figure 3:
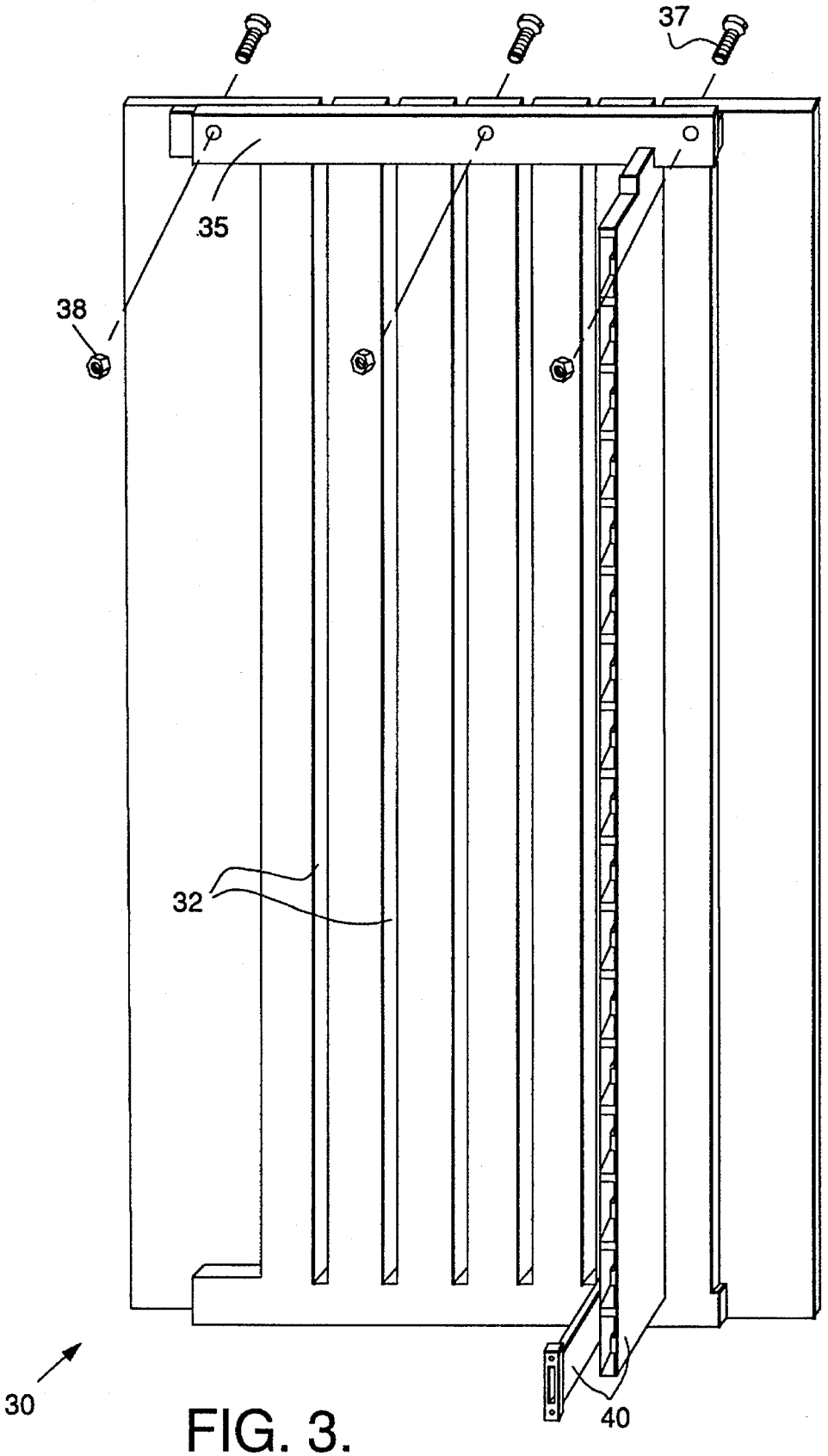
FIG. 3 shows a perspective view of a multi-channel complex microwave assembly flow-inducing panel in accordance with the principles of the present invention.
Figure 4:
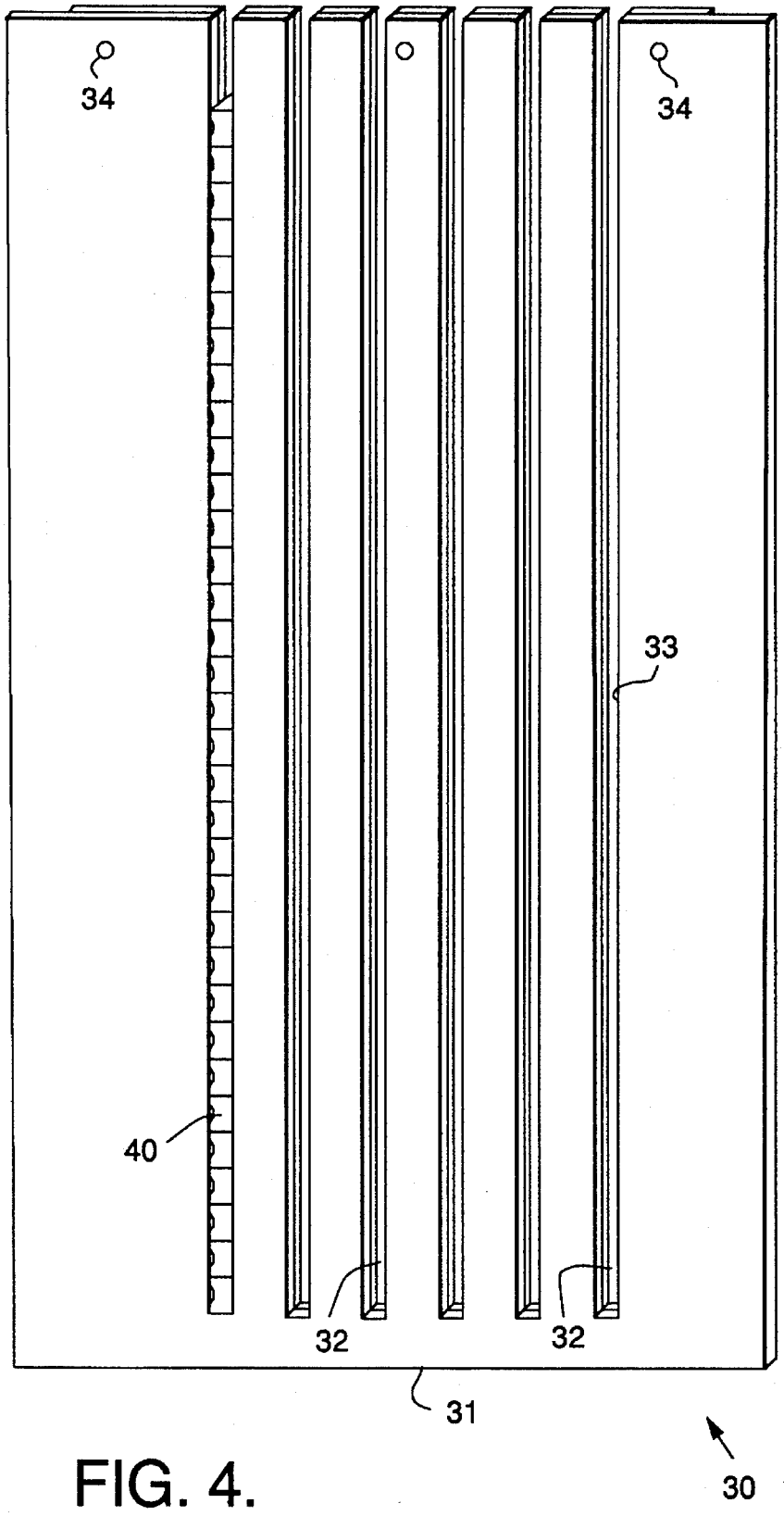
FIG. 4 shows a rear view of the multi-channel complex microwave assembly flow-inducing panel of FIG. 3.

FIG. 3 shows an embodiment of a perspective view of a multi-channel complex microwave assembly flow-inducing panel 30 in accordance with the principles of the present invention, while FIG. 4 shows a rear view of the multi-channel panel 30 of FIG. 3. FIG. 3 shows an assembled multi-channel panel 30 having a second type of complex microwave assembly 40 disposed therein.

The multi-channel panel 30 is comprised of a copper clad panel 31 having a plurality of slots 32 disposed therein. Additionally, each of the slots 32 have a step 33 disposed along an edge thereof. A plurality of holes 34 are disposed along a top edge of the copper clad panel 31 that are adapted to mate with a plurality of mating holes 36 disposed in a cover block 35 or cover 35. The cover block 35 is secured to the copper clad panel 31 by means of machine screws 37 and nuts 38, for example.

In this embodiment of the multi-channel panel 30, a 12 inch×18 inch copper clad panel 31 is routed to make six slots 32, each having the step 33 disposed along at least one edge thereof. After the insertion of 6 complex assemblies 40 to the slots 32, the copper clad panel 31 is assembled using the cover block 35 and the screws 37 and nuts 38. As in the case of the single channel panel 10, two assembled multi-channel panels 30 are placed in a conventional metallization basket (not shown) used for PWB manufacturing. The multi-channel complex microwave assembly flow-inducing panels 30 were tested for electroless copper plating during a proof-of-manufacturing test period. As in the case of the single channel panels 10, complete coverage of electroless copper plating on the inner surfaces of the complex channels 40 was obtained.

The flow-inducing panels 10, 30 of the present invention induce maximized solution flow through channels in the complex microwave assemblies 20, 40 by minimizing solution flow bypassing. The relatively large (12 inch × 18 inch) flow-inducing panels 11, 31 creates a pressure differential as they move through the plating tank 45 (FIG. 5), thus forcing solution through the channels in the complex microwave assemblies 20, 40.

The flow-inducing panels 10, 30 of the present invention provide sufficient solution flow through the channels in complex microwave assemblies 20, 40. The complete coverage of electroless copper plating on the inner surfaces of the channels is necessitated to ensure minimum RF energy loss therein. The advantages of the present flow-inducing panels 10, 30 are to easily hold many assemblies 20, 40 in a stabilized manner which yields high productivity, and to easily provide solution flow through the channels using the standard metallization basket used for printed wiring board manufacturing.

Figure 5:
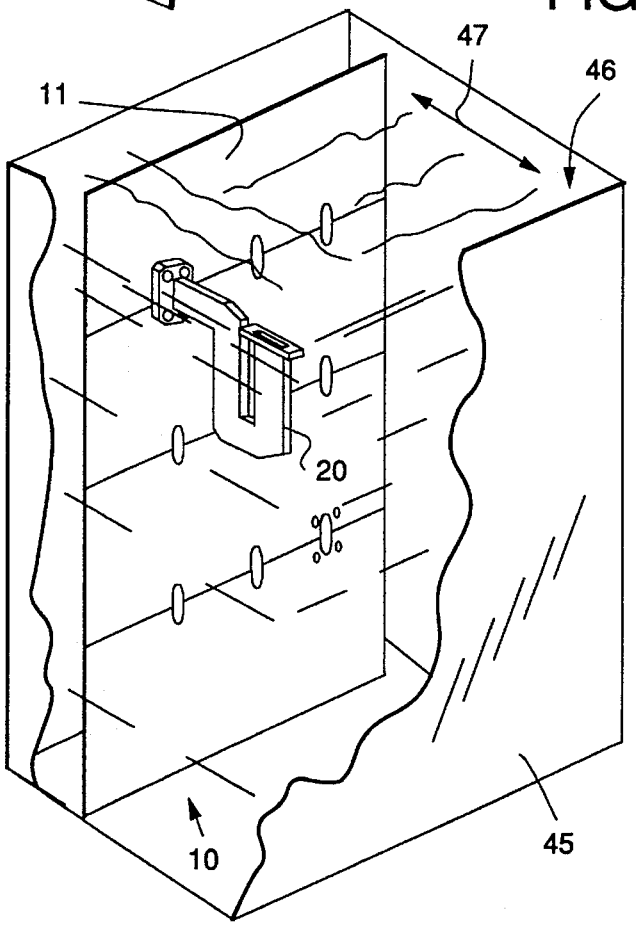
FIG. 5 shows a typical single channel flow-inducing panel disposed in a plating tank in order to illustrate the operation of the present invention.

FIG. 5 shows a typical single channel flow-inducing panel 10 disposed in a plating tank 45 containing plating solution 46 to illustrate the operation of the present invention. The panel 10 has a relatively large size with respect to the size of the tank 40. Consequently, this relative sizing arrangement minimizes the amount of solution that bypasses the channels of the microwave assembly 20. The panel 10 is agitated in the plating tank 45, as is illustrated by the double headed arrow 47 in FIG. 5, thus creating solution flow through the microwave assembly 20. This results in a more uniform plating of the microwave assembly 20.

Thus there has been described new and improved single and multi-channel complex microwave assembly flow-inducing panels. It is to be understood that the above-described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A flow inducing panel in combination with an electroless copper plating tank for electroless copper plating complex microwave assemblies, said panel comprising:

a rigid baffle having a plurality of openings therein structured and arranged to secure a plurality of microwave assemblies therein, the rigid baffle having a size relative to the electoless copper plating tank that is structured and arranged to cause sufficient plating solution flow through channels disposed in the microwave assemblies disposed therein by minimizing solution flow bypassing of the channels thereof to achieve complete copper plating of inner surfaces in the channels, wherein the rigid baffle is comprised of a plurality of substantially coplanar panels that are joined to form a single panel and which are secured together using cover members and securing means for mating the cover members to each of the panels; and means for securing each of the plurality of complex microwave assemblies in respective ones of the plurality of openings of the rigid baffle.

2. The flow inducing panel of claim 1 wherein the means for securing comprises at least one rubber plug.

3. The flow inducing panel of claim 1 wherein the means for securing comprises at least one plastic plug.

4. The flow inducing panel of claim 1 wherein is the plurality of openings comprises a plurality of slots disposed in the single panel and each said slot have a stepped portion, said slot is structured and arranged to secure the microwave assembly therein and permit the plating solution to flow through the channels of the microwave assembly.

5. A flow inducing panel in combination with an electroless copper plating tank for electroless copper plating complex microwave assemblies, said panel comprising:

a rigid baffle having a plurality of openings therein structured and arranged to secure a plurality of microwave assemblies therein, the rigid baffle having a size relative to the electroless copper plating tank that is structured and arranged to cause sufficient plating solution flow through channels dispose in the microwave assemblies disposed therein by minimizing solution flow bypassing of the channels thereof to achieve complete copper plating of inner surfaces in the channels, wherein the rigid baffle is comprised of a plurality of substantially coplanar copper clad panels that are joined to form a single panel and which are secured together using cover members and securing means for mating the cover members to each of the panels; and means for securing each of the plurality of complex microwave assemblies in respective ones of the plurality of openings of the rigid baffle.

6. The flow inducing panel of claim 5 wherein the plurality of cover member are plurality of cover blocks and securing means is comprised of screws to mate the cover blocks to each of the panels.

7. The flow inducing panel of claim 5 wherein the means for securing comprises at least one rubber plug.

8. The flow inducing panel of claim 5 wherein the means for securing comprises at least one plastic plug.

9. The flow inducing panel of claim 5 wherein the plurality of openings comprises a plurality of slots disposed in the single panel and each said slot have a stepped portion, said slot is structured and arranged to secure the microwave assembly therein and permit the plating solution to flow though the channels of the microwave assemblies.

* * * * *